United States Patent [19]

Wirth et al.

[11] 4,016,965

[45] Apr. 12, 1977

[54] MATRIX PRINT HEAD AND SOLENOID DRIVER

[75] Inventors: Robert L. Wirth; David W. Bell, both of Ithaca, N.Y.

[73] Assignee: NCR Corporation, Dayton, Ohio

[22] Filed: Aug. 19, 1975

[21] Appl. No.: 605,970

[52] U.S. Cl. ..... 197/1 R; 335/258; 335/274

[51] Int. Cl.[2] ..... B41J 3/04

[58] Field of Search ..... 197/1 R; 101/93.04, 101/93.05; 335/255, 258, 260, 261, 262, 279, 281, 274

[56] References Cited

UNITED STATES PATENTS

| | | | |
|---|---|---|---|
| 3,729,079 | 4/1973 | Zenner et al. | 197/1 R |
| 3,787,791 | 1/1974 | Borger et al. | 335/274 |
| 3,820,643 | 6/1974 | Priebs et al. | 197/1 R |
| 3,850,278 | 11/1974 | Mihm et al. | 197/1 R |
| 3,897,865 | 8/1975 | Darwin et al. | 197/1 R |
| 3,900,094 | 8/1975 | Larsen et al. | 197/1 R |
| 3,940,726 | 2/1976 | Gershnow | 335/274 |
| 3,946,851 | 3/1976 | Cestrieres et al. | 197/1 R |

*Primary Examiner*—Ralph T. Rader
*Attorney, Agent, or Firm*—J. T. Cavender; Wilbert Hawk, Jr.; Jeffrey P. Morris

[57] ABSTRACT

A matrix print wire solenoid actuator for a high speed wire matrix printer is disclosed wherein a small diameter print wire is propelled against printing paper and ribbon by the linear motion of the solenoid plunger, to which the print wire is attached, in an improved impact printer having one or more in number and variously arranged print wires for use in dot matrix printing. High magnetic circuit efficiency, high repetition rate and minimized plunger coil heating and plunger mass are achieved by providing a continuous magnetic flux path through the solenoid interrupted only by two working air gaps of low reluctance for generating accelerating force on the plunger during coil energization. The opposing air gap surfaces formed by the plunger and solenoid pole pieces are conical for insuring that both air gaps generate accelerating force on the plunger.

24 Claims, 5 Drawing Figures

PRIOR ART

MATRIX PRINT HEAD AND SOLENOID DRIVER

BACKGROUND OF THE INVENTION

1. Field of the Invention

The present invention relates generally to impact printing devices for dot matrix printing wherein at least one print wire is propelled against a printing medium by an associated plunger type solenoid print wire driver for printing dot matrix characters in accordance with external control signals which cause plunger coil energization and consequent character printing. More particularly, the present invention relates to an improved print wire solenoid driver having a rapid cycle repeat time and a low loss magnetic circuit of high efficiency and durability.

2. Description of the Prior Art

Modern high speed matrix printers must have print heads capable of printing a variety of fonts at ever increasing speeds, while maintaining reliability of operation, cost efficiency and durability. Prior art print heads having plunger type solenoids for driving print wires generally suffer from the inability to achieve low enough plunger cycle repeat times to enable the printer to operate at peak printing speeds. This deficiency of prior art solenoid print wire drivers results from a variety of factors; among which are: excessive plunger mass which reduces plunger acceleration, non-working air-gaps in the solenoid magnetic circuit, which increase reluctance in the magnetic circuit with a consequent decrease in efficiency. Other problems associated with prior art solenoids include, less than optimum flux density in the plunger, and electrical heating in the plunger coil, both of which reduce the solenoid efficiency.

One such prior art solenoid for a wire printer is described by U.S. Pat. No. 3,787,791, which prior art solenoid is more completely described with reference to FIG. 1 herein. As will be described, this prior art solenoid contains two air gaps, one of which is non-working and the other of which, while developing a maximum force for a given magnetic flux, requires a maximum magnetomotive force derived from additional ampere-turns of coil to develop that force, adding to the electrical resistance of the plunger coil and decreasing the solenoid efficiency.

SUMMARY OF THE INVENTION

The present invention comprises a plunger type solenoid for driving the wire element of an impact printer for dot matrix printing. A print head comprised of a plurality of solenoids of the present invention driving a plurality of print wires at high speed has the ability to print high speed dot matrix fonts with a high degree of accuracy and repeatability. A substantially continuous flux path is provided through the solenoid interrupted only by two plunger accelerating force generating air gaps of low reluctance. No restrictions are interposed in the flux path, as all cross sectional areas of the flux path are larger than the plunger cross sectional area. The plunger surfaces at the working air gaps are conical within a range of angular values sufficient to maintain an optimum or near optimum flux density in the air gaps. The plunger contains a central through hole containing the print wire which is attached thereto without degrading the magnetic properties of the plunger, i.e., the plunger is not "necked down" as by prior art mechanical swedging attachment techniques.

It is therefore an object of the present invention to provide an improved wire printer having one or a plurality of high speed matrix print wire solenoid actuators.

It is another object of the present invention to provide an improved matrix print wire solenoid actuator magnetic circuit for use in matrix wire printers.

It is another object of the present invention to provide a print wire solenoid of small size and low plunger mass.

It is yet another object of the present invention to provide a high speed print wire solenoid of high magnetic efficiency with minimized magnetic circuit losses and increased flux density in the plunger per ampere turn of coil.

It is yet another object of the present invention to provide an improved solenoid construction wherein the air gaps between the solenoid plunger and pole piece surfaces are conical.

It is yet another object of the present invention to provide a print wire drive solenoid having two working air gaps for driving a print wire at high speed with minimized coil heating at a high duty cycle and with a minimized drain on the solenoid power supply.

The foregoing and other objects, features and advantages of the invention will be apparent from the following detailed description of the preferred embodiments of the invention as illustrated by the accompanying drawings wherein:

DESCRIPTION OF THE PREFERRED EMBODIMENT

Figure 1:
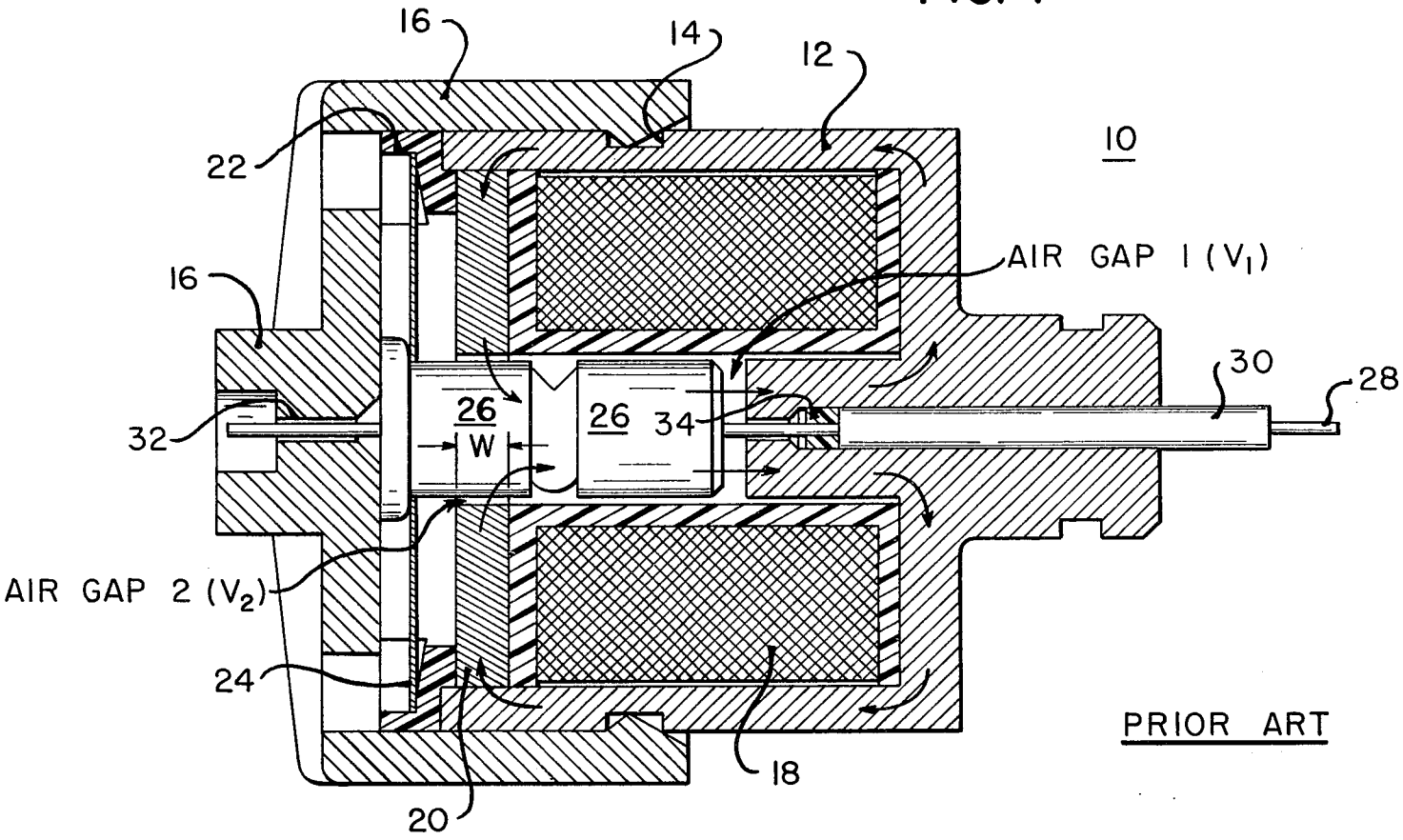
FIG. 1 is a matrix print wire solenoid of the prior art.

Referring now to FIG. 1, a print wire solenoid driver in accordance with that of the aforementioned prior art U.S. Pat. No. 3,787,791 is illustrated generally at 10. An external metal housing 12 is provided with a circumferential groove 14 in the outer surface thereof which provides a snap fit engagement for an end cap 16 thereon. Mounted within the solenoid housing 12 is a coil 18 consisting of a plurality of turns of wire wound on a spool abutting a pole piece 20. A spring seat, in the form of a plastic ring 22 defining a flange, fits into and engages the rear of housing 12 and pole piece 20. Spring seat 22 receives a flat steel spring 24 having a central recess for slidably receiving the plunger 26 which flexes the spring 24.

A print wire 28 is contained within a central bore through plunger 26 and is attached to the plunger by swedging, with the forward end thereof received through an associated guide sleeve 30. Bearings 32 and 34 surround the print wire 28 at the end cap 16 and forwardly of the plunger 26. When the coil 18 is energized, the plunger 26 is driven forward by completion of the illustrated flux path. Deenergization of the coil 18 permits the plunger and print wire 28 attached thereto to be restored by the spring 24 to an inactive position. The aforementioned solenoid has a cycle rate of about 1.2 milliseconds with a working stroke of about 0.015 inch. As is apparent from an examination of the primary flux path illustrated by the curved arrows, air gap 2 is non-working while air gap 1, having flat, parallel opposing surfaces requires maximum ampere-turns to develop maximum force for a given flux. Additionally, the mechanical swedging of the print wire to the plunger with the resultant necking of the plunger restricts the magnetic path.

The gap reluctance, magnetomotive force and the magnetic force of the solenoid of FIG. 1 are hereafter computed for purposes of comparison with the same magnetic parameters of the present invention to illustrate the increased efficiency of the present invention. Dimensions $V_1$, $V_2$ for air gaps 1 and 2, and W of pole piece 20 are as illustrated by FIG. 1. The mathematical expressions for calculating the various parameters of magnetic circuits are well known, and may be found, for example, in *Electromagnetic Devices, Rotors*, John Wiley and Sons, New York, 1941. In the following calculation:

$R$ = gap reluctance (ampere-turns per weber)
$NI$ = magnetomotive force in ampere-turns
$F$ = magnetic force in pounds
$B$ = flux density in gauss
$\mu$ = permeability of air ($3.192\times10^{-8}$ webers per ampere-turn per inch)
$A$ = plunger cross sectional area
$\alpha$ = the angle of the air gap with respect to coil windings, then, for air gap 1:

$$R=\frac{V_1 \cos^2 \alpha}{\mu\pi(r_2-r_1)\,(r_1+r_2+V_1\cos\alpha\,\sin\alpha)} \qquad \text{(eq. 1)}$$

and for air gap 2:

$$R=\frac{(r_3-r_2)}{\mu\pi W(r_3+r_2)} \qquad \text{(eq. 2)}$$

where $r_1$, and $r_2$ are radii from the center to the peripheral surface of air gap 1 and $r_3$ extends to pole piece 20.

Assuming a flux density (B) of 16,000 gauss in the plunger and that all of the flux passing through air gap 1 also passes through air gap 2; i.e. that there is no fringing from the plunger; and also assuming that the working gap 1 has a measured width of 0.027 inches, then, utilizing equations 1 and 2 above and equations 3 and 4 supra, the following magnetic parameters are calculated for the illustrated prior art solenoid.

| | Air Gap 1 | Air Gap 2 | Total (Gaps 1 + 2) |
|---|---|---|---|
| R | $0.962\times10^8$ | $0.170\times10^8$ | $1.132\times10^8$ |
| NI | 918 | 162 | 1070 |
| F | 1.44 | 0 | 1.44 |

Figure 2:
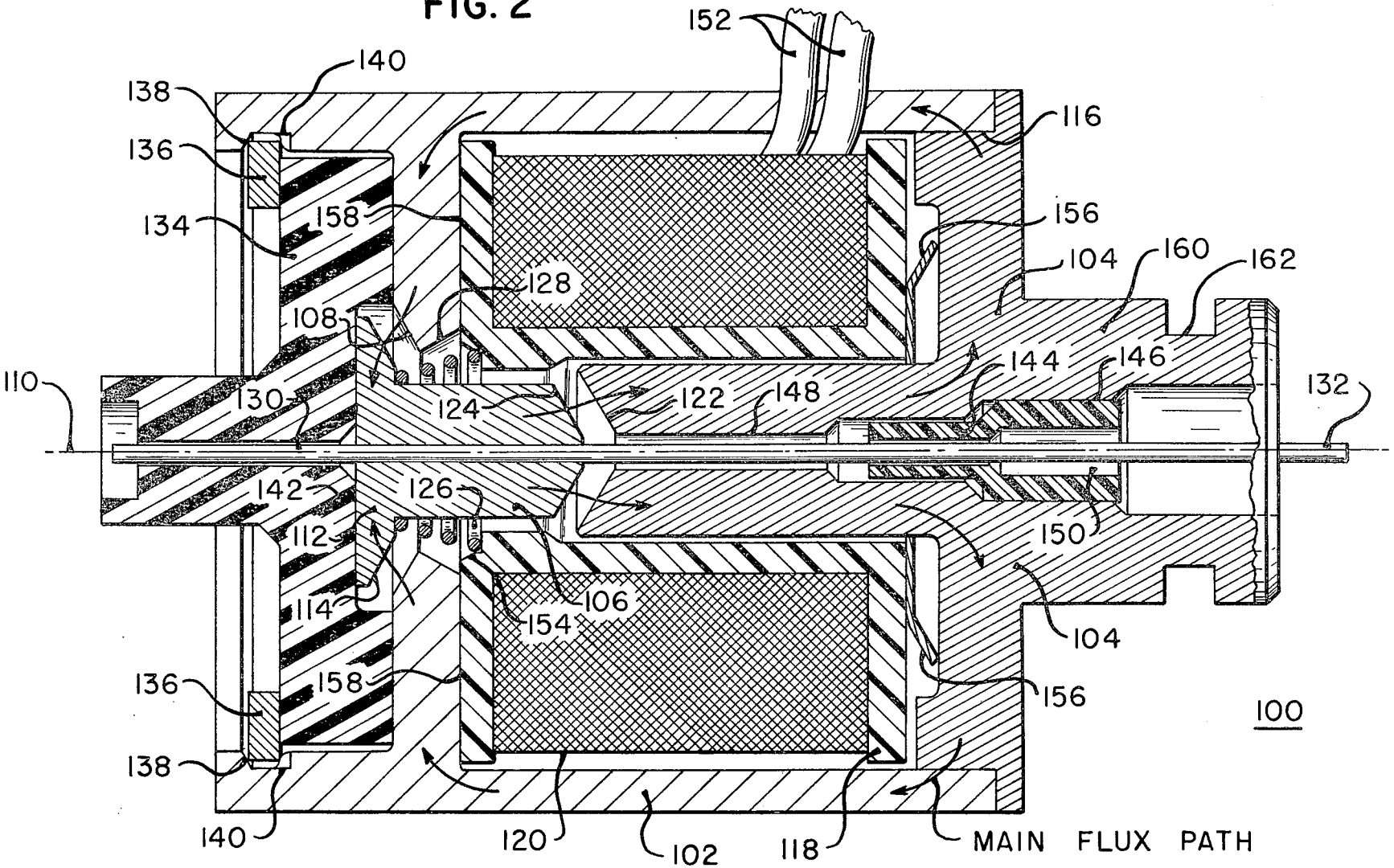
FIG. 2 is a matrix print wire solenoid driver in accordance with the present invention.

Referring now to FIG. 2, a matrix print wire solenoid actuator in accordance with the present invention is illustrated generally at 100, with the curved arrows indicative of the main magnetic flux path. The magnetic flux path is entirely through steel and two working air gaps comprising the main magnetic circuit. An outer housing 102 comprised of a one-piece cylindrical shell; a stationary core piece 104; and a movable plunger 106; together with the air gaps 1 and 2 (see also FIG. 4) comprise the main magnetic circuit. Housing 102, core piece 104 and plunger 106 are all made of soft steel. The housing 102 has one end thereof open and the opposite end thereof partially closed, the partially closed end having an annular opening therein defined by a conical surface 108, through which annular opening the plunger moves along centerline 110. One end of plunger 106 is flanged (flanged end 112) such that the conical surface 108 of the housing 102 functions as a pole piece for the flanged end 112 of plunger 106, which flanged end 112 has a conical surface 114 matching that of housing conical surface 108. The stationary pole piece 104 is press fitted into the open end of the housing 102 at surface 116 thereof after the bobbin 118 with coil windings 120 wound thereon is placed inside the housing. The core piece 104 extends partially through the coil windings 120, completing the flux path up to air gap 1 and terminating with a conical surface 122 which opposes and matches a forward conical surface 124 of the plunger 106, which conical surface 124 forms the other side of air gap 1. Air gap 2 is defined by the previous opposing conical surfaces 108 and 114 of the housing 102 and plunger 106. The flanged end 112 of plunger 106 thus performs the dual function of providing a seat for a plunger return spring 126 and also providing a magnetic flux path from the air gap 2 to the main body of plunger 106.

Figure 3:
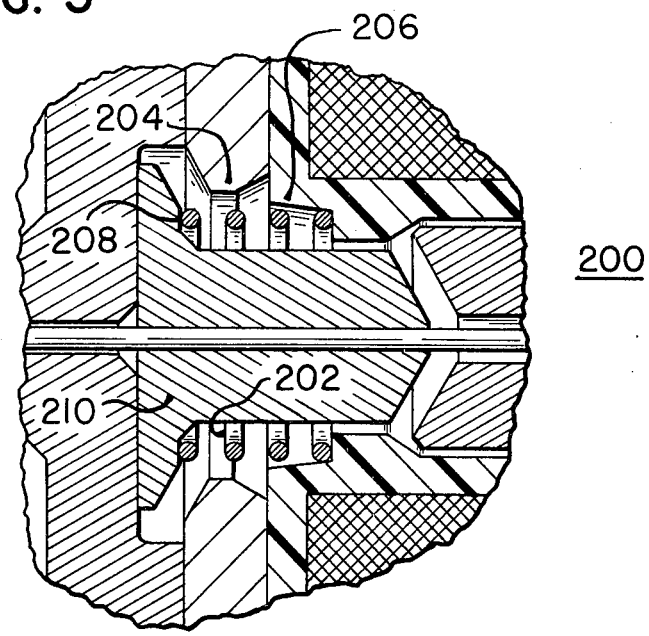
FIG. 3 is a break-away view of FIG. 2 for illustrating another embodiment of the present invention.

The plunger return spring 126 is shown as a conical coil spring in FIG. 2 and as a straight coil spring in the embodiment illustrated by FIG. 3, either of which spring configurations being capable of satisfactory operation. A typical spring 126 is constructed of nonmagnetic berylium copper spring wire, having acceptable resistance to fatigue and having a small number of coils. The small number of coils of spring 126, illustrated as four by FIG. 2, provides a high resonant frequency, approximately greater than 3000 Hz, which allows high plunger speeds without spring surge.

It is apparent from FIG. 2 that the cross sectional area of the flanged portion 112 of plunger 106 normal to the lines of magnetic flux is at all points greater than the cross sectional area of the plunger main body (i.e., forward of such flanged portion 112), thereby introducing no restriction into the flux path. Also, as previously described, the opposing surfaces of the air gaps 1 and 2 defined by the plunger, housing and core piece surfaces are all conical, which serves to reduce the magnetic reluctance of the air gaps for a given maximum available plunger working stroke distance. By way of example, the choice of an angle $\alpha$ for the plunger surface 124 as illustrated of 30° has been found to reduce the magnetic reluctance at air gap 1 by approximately 36 percent from that reluctance which would occur when angle $\alpha$ is equal to zero degrees, as in FIG. 1.

Surface 128 of the housing 102, adjacent the plunger main body, is sloped away from the plunger body to prevent magnetic flux from fringing across from such surface 128 to the plunger body, which slope also provides space for the return spring 126, which spring, likewise being nonmagnetic, does not conduct fringing flux, all of which functions to maximize the flux density in air gap 2 and to insure a low reluctance in the gap. The air gap 2 of the present invention is a working air gap in contradistinction to the non-working air gap 2 of the prior art, which prior art air gap 2 also serves to add reluctance to the magnetic circuit without contributing any additional magnetic force.

The entire plunger mass of the present invention is utilized in the magnetic flux path with no portions thereof being utilized for secondary (non-magnetic-force-producing) purposes, such as spring attachment, which secondary purposes add mass which, as will become apparent, reduces the plunger accelerating capability. Plunger 106 contains a central through hole within which resides a print wire 132, which print wire is fastened to the plunger 106 by means of epoxy — preferably a single component, high temperature, semi-flexible epoxy with sufficient shear strength to be unaffected by the repeated loading normally encountered in impact printing. A number of such type epoxys are commercially available. The above-described method of attachment of the print wire 132 to the plunger 106 does not degrade the magnetic properties of the plunger as does the flux restricting mechanical swaging method of print wire attachment of the prior art.

An end cap 134 is fastened to the closed end of housing 102 and locked into position thereon by means of an internal snap ring 136 which engages a rear beveled surface 138 on an internal circumferential groove 140 within the housing rear extension. Beveled surface 138 of groove 140 generates a forward force vector from the force present between the snap ring 136 and the end cap 134 for insuring that the end cap is securely locked into position against the housing 102, even when subjected to extremes of tolerance conditions and operating conditions. It is critical that the end cap be held securely as described, since, if the end cap 134 were not securely locked against the housing, the plunger starting position at surface 142 would vary, which in turn would vary the plunger reset force exerted by the reset spring 126 and would cause the start position air gap widths 1 and 2 to vary, resulting in erratic performance of the solenoid at high cycle rates.

Bearing support for the plunger 106 and print wire 132 assembly is provided at the rearward portion thereof by the rear portion of end cap 134, as at 130, and at the forward portion thereof by a bearing 144 which is press fitted at surface 146 thereof into a bore in the core piece 104. Forward of the plunger 106, the print wire 132 passes through a clearance hole 148 in the core piece 104, and then through the forward bearing 144. The end cap 134 and the front bearing 144 are preferably plastic, such as Teflon filled acetal (manufactured by E. I. duPont deNemours and Co., Inc. under the trademark Delrin AF), which plastic material provides low friction and good durability. As previously mentioned, the inner surface of end cap 134 functions as the end stop for plunger 106 (at end cap surface 142) on the plunger return stroke, and also provides a fixed starting position for the plunger prior to coil energization; hence, the end cap material should also resist cold flow under repeated impact. Front bearing 144 is stepped, having a large diameter portion and a small diameter portion. The large diameter portion, as previously described is press fit into the core piece 104 while the small diameter portion containing the print wire bearing area is not affected by the press fit. Recessed bore portion 150 in the large diameter portion of such bearing 144 may be utilized to receive and support any sleeve tubing which may be present as a print wire guide or support in the matrix print head.

The bobbin 118 may comprise molded glass reinforced nylon containing, in an exemplary embodiment, 450 turns of AWG No. 32 copper magnet wire wrapped therearound as coil winding 120. The wire leads 152 from coil winding 120 are passed through an aperture in housing 102 for coupling to the external drive electronics, which supply the appropriate energization pulses thereto in accordance with a predetermined control for generation of the requisite print wire actuating sequences which ultimately result in, for example, alphanumeric dot matrix characters being printed by the print head. A portion of the seat for plunger spring 126 may be molded at bobbin surface 154 as an integral part of the bobbin.

Rearward force is exerted against the bobbin 118 by a curved spring washer 156 positioned forward of the bobbin and compressed by its position between bobbin 118 and pole piece 104. The aforementioned rearward force provided by spring washer 156 is required to maintain the bobbin 118 firmly against the inner surface of the housing at surface 158 thereof to minimize bobbin movement which might affect the location of the plunger return spring seat surface 154 with a consequent undesirable variation in the spring preset force, which preset force insures the return of plunger 106 to its starting position at a surface 142 of the end cap 134. The rearward force exerted by the spring washer 156 additionally functions to substantially prevent movement of the bobbin from forces created by the plunger spring 126 force and other vibrational forces exerted on the bobbin during plunger energization and deenergization. Any bobbin movement as aforementioned would result in a variation or loss of force in the spring 126 which, in a solenoid operable at the high cycle rate of the instant invention, would degrade the dynamic performance of the plunger. The disclosed orientation of spring washer 156 insures that its developed rearward force is exerted near the inner core area of the bobbin rather than against the outer winding area so as to overcome any possibility thereof to crush the coil windings 120.

It is to be understood that in matrix printing, a plurality of solenoids of the type described with reference to FIG. 2 may be required, the ultimate number in many instances depending upon the number of dots comprising the character font. Thus, in a 5 × 7 character font, up to seven print wires may be employed in the print head. Typically, the individual solenoids are attached to a supporting structure; i.e., the housing of the matrix print head containing the solenoids. To this end, the extended front portion 160 of pole piece 104 (FIG. 2) is passed through a solenoid receiving aperture in the print head described with reference to FIG. 5. A bowed E-ring or other fastening means may then be snapped into an annular groove 162 in pole piece 104 on the front extention 160 for securing the solenoid assembly to the print head, together with other like solenoids similarly fastened to the print head.

The invention hereof has exceptionally efficient magnetic circuit characteristics. A typical choice of parameters, illustrated by FIG. 4 as a break-away view of the air gap detail of FIG. 2, is as follows:

| | $r_1$ | $r_2$ | $V_{(max)}$ | $\alpha$ |
|---|---|---|---|---|
| air gap 1: | .015" | .055" | .027" | 30° |

-continued

| | $r_1$ | $r_2$ | $V_{(max)}$ | $\alpha$ |
|---|---|---|---|---|
| air gap 2: | .075" | .1125" | .027" | 30° |

Figure 4:
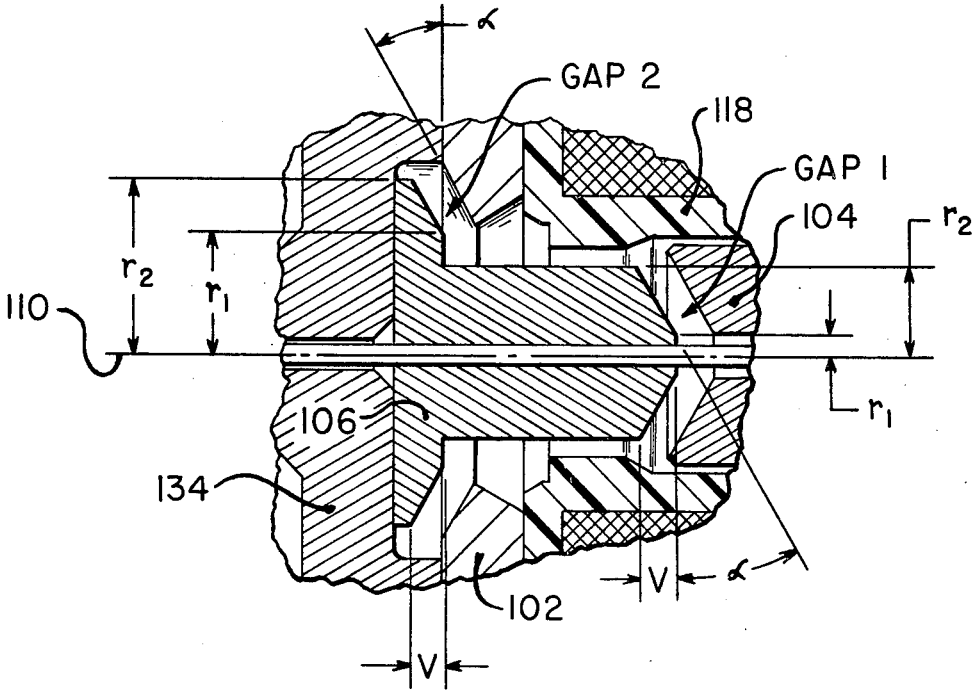
FIG. 4 is a break-away view of FIG. 2 for illustrating certain features of the present invention in greater detail.

Like numerals in FIG. 4 illustrate like components of FIG. 2, with the addition for clarity of description of typical dimensions of the air gaps. Also, for clarity, the plunger return spring has been omitted. Assuming a flux density of 16,000 gauss in the plunger and no fringing as in the previous calculation, using Equation 1 to derive reluctance in the air gap and:

$$NI = 6.45\times10^{-8} \text{ BAR Ampere-Turns} \quad \text{(eq. 3)}$$

Equation 3 to derive magnetomotive force, and:

$$F = 4.43\ (6.45\times10^{-8}\text{BA})^2\ (dR/dV) \text{ Pounds} \quad \text{(eq. 4)}$$

Equation 4 to derive magnetic force, which equations may be found in the aforementioned reference by John Wiley and Sons, the following results are derived.

| | Gap 1 | Gap 2 | Total (Gaps 1 & 2) |
|---|---|---|---|
| R | $0.618 \times 10^8$ | $0.27 \times 10^8$ | $0.888 \times 10^8$ |
| NI | 590 | 258 | 848 |
| F | 0.79 | 0.38 | 1.17 |

A comparison of the above magnetic characteristics for the present invention with those of the magnetic circuit described with reference to FIG. 1 (prior art) evidences a substantial reduction in the Reluctance and the ampereturn input (magnetomotive force) at a slight sacrifice in peak accelerating force on the plunger. However, due to the aforedescribed plunger design, the mass thereof is substantially reduced from that of FIG. 1 (by actual measurement from 0.462 gram to 0.291 gram); hence, the plunger acceleration is actually substantially improved by the present invention. The following calculation is illustrative in this regard. Considering Newton's second law:

$$A_p = (F/M)$$

where:
$A_p$ is the plunger acceleration
$F$ is the magnetic force
$M$ is the plunger mass
then:

$$A_p = \frac{1.17}{1.66 \times 10^{-6}} = 7.05 \times 10^5 \text{ in/sec}^2$$

for the instant invention, while $$A_p = \frac{1.44}{2.64 \times 10^{-6}} = 5.45 \times 10^5 \text{ in/sec}^2$$

for the prior art solenoid illustrated by FIG. 1. A 29% increase in peak acceleration is achieved with a 21 percent decrease in ampere-turn input, with the excitation coil being smaller, having fewer turns of wire with less electrical resistance.

While the preceding calculations have been obtained with an angle $\alpha$ of 30° from the vertical, it is to be understood that a 30° angle is not necessarily optimum, but is within the range of angular values between approximately 20° to 35° which results in high plunger acceleration and efficiency of operation. Typically, the present invention has a plunger cycle repeat time of less than 0.85 milliseconds with a 0.015 inch working stroke with a watt-second input of less than 0.011.

Referring now to FIG. 3, a break-away view of the plunger return spring and surrounding area of FIG. 2 is illustrated generally at 200, wherein, as an alternative to the use of a conical coil spring, a straight coil spring is utilized. Such utilization of a straight spring 202 is desirable in that special orientation thereof during assembly is not required. The use of a straight spring does not restrict the air gaps in any manner. The only required constructional changes are a somewhat shortened housing pole piece 204, a greater groove in bobbin 206 and an additional recess at 208 in plunger 210.

Figure 5:
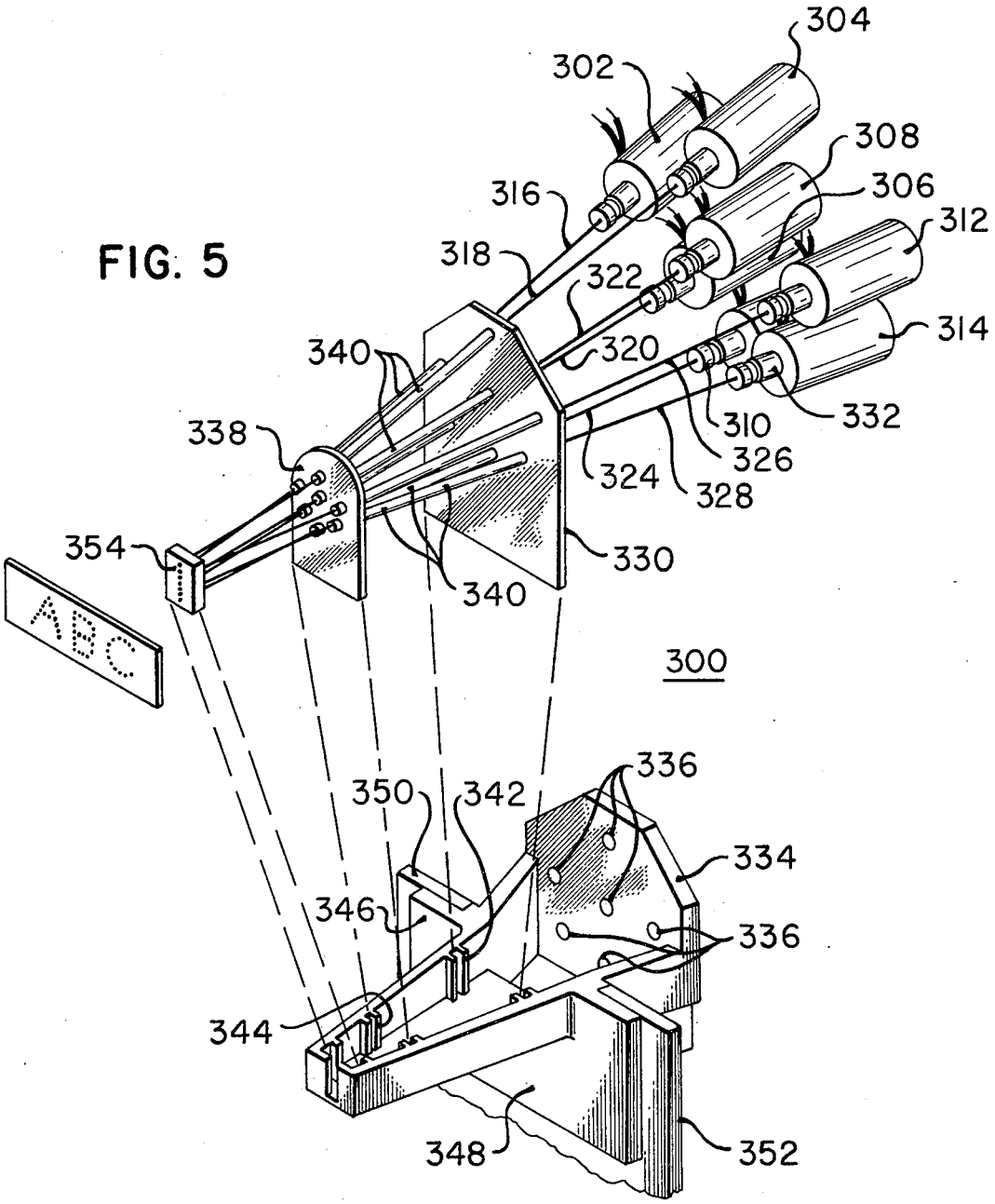
FIG. 5 is an exploded perspective view of a representative print head assembly incorporating the present invention.

Referring now to FIG. 5, an exploded view of a dot matrix print head assembly utilizing a plurality of print wire drive solenoids of the present invention is illustrated generally at 300. It is to be understood that the increased cycle repeat time obtainable with the instant solenoid enables the print head as a whole to achieve exceptionally high printing speeds. While many possible print head configurations are possible, both with respect to number of wires and wire orientation, the illustrated configuration is representative of an organization of print wires into a vertically aligned column of print wires. The construction of such a print head configuration using solenoids of the prior art is well known, with U.S. Pat. No. 3,690,431 being illstrative in this regard.

As seen in FIG. 5, solenoids 302, 304, 306, 308, 312, and 314 drive small diameter print wires 316, 318, 320, 322, 324, 326 and 328, respectively, in a vertically disposed seven wire configuration. The drive solenoids are fastened to a print head solenoid positioning wall 330 by their forward housing grooves 332 as explained with reference to FIG. 2. A print head structural assembly 334 having a plurality of holes 336 in the print wire receiving end thereof, together with positioning wall 330 and an additional wire positioning wall 338 having a plurality of holes therein, position wire guides 340 which surround the individual print wires into a fixed configuration, the ends of which wire guides rearwardly of the positioning wall 330 terminate in the recessed axial bores 150 (FIG. 2) of the drive solenoids. Guide slots 342 and 344 in the print head assembly 334 position and rigidize wire positioning walls 330 and 338 therein. Flanges 346 and 348 serve to secure the print head housing to printer mounting plates 350 and 352, respectively, which provide for horizontal movement of the entire assembly 334 during the printing operation. Final alignment of the print wires is accomplished by a guide slot assembly 354 having a vertical column of apertures therein.

It is clear that the print head as illustrated in FIG. 5 will simultaneously print one vertical segment of a character during each operation thereof, with a plurality of print head incrementations being required for completing the remaining segments of such character (typically five for a 5 × 7 character dot matrix).

An alternative configuration of multiple solenoid driven print wires to that illustrated in FIG. 5 may define a horizontal row of, for example, five print wires, spaced to simultaneously print one horizontal segment of a character, after which the five print wires are incremented as a unit to the like horizontal segment of the next character position. At the conclusion of the printing of a complete row of such character segments, each segment of course consisting of a plurality of dots, the printing paper is vertically incremented to enable printing of a next row of character segments in a like manner. After a predetermined number of paper incrementations, typically seven for a 5 × 7 character dot matrix, an entire row of characters is printed.

It is also to be understood that a single solenoid actuated print wire may, in certain matrix printing applications, comprise a complete print head. The single print wire in such a configuration prints a line of characters incrementally by means of the printing paper being incremented vertically following the print wire concluding each character segment row, with complete characters being produced at the conclusion of a predetermined number of such paper incrementations.

A variation of the above single solenoid printing head is a horizontally spaced plurality of solenoid actuated print wires, spaced, for example, ten characters apart such that each print wire is used to print only a portion of each row of characters. The printing is incremented as in the single print wire configuration such that the simultaneous horizontal printing of the plurality of print wires produces an increased printing speed.

While the invention has been shown and described with reference to the preferred embodiments thereof, it will be understood that persons skilled in the art may make modifications thereof without departing from the spirit and scope of the invention as defined by the claims appended hereto.

What is claimed is:

1. A magnetic circuit comprising:

a coil for providing magnetic flux when energized by an electrical current;

flux conductive means for providing a substantially continuous non-restricted path for said flux comprising a housing having a stationary core member enclosing one end thereof and an annular pole piece substantially closing the other end thereof and a plunger reciprocally movable in one direction with respect to said core member, said plunger having a flanged end including an inner conical surface aligned with a companion outer surface of said pole piece and an opposite end including a conical surface aligned with a companion conical surface of said core member; and plunger return means yieldingly urging said plunger to a normal position defining a first and a second low reluctance air gap between said plunger conical surfaces and said companion pole piece and core member conical surfaces for generating upon energization of said coil a composite accelerating magnetic force on said plunger in part by each of said air gaps.

2. A magnetic circuit in accordance with claim 1 wherein the angle of said air gaps with respect to the orthogonal direction of motion of said plunger formed by the conical surfaces of said plunger and the conical surfaces of said pole piece and core member is greater than or equal to 20° and less than or equal to 35°.

3. A magnetic circuit in accordance with claim 1 wherein said housing, said pole piece, and said plunger are comprised of soft steel.

4. A solenoid for driving a printing wire in a matrix printer comprising:

a coil for providing magnetic flux when energized by an electrical current;

means for providing a substantially continuous, non-restricted path for said magnetic flux including a housing having a stationary core member enclosing one end thereof and an annular pole piece substantially closing the other end thereof and a plunger movable in one direction with respect to a central axis through said core member and pole piece;

a first low reluctance air gap between said core member and said plunger defined by a forward conical surface of said plunger and a matching conical surface of said core member;

a second low reluctance air gap between said pole piece and said plunger defined by an inner conical surface of a flanged rear end of said plunger and a matching outer conical surface of said pole piece;

a printing wire fastened to said plunger extending through said core member and movable with said plunger; and means for energizing said coil such that a composite accelerating force is generated on said plunger, said composite accelerating force being generated in part by each of said air gaps.

5. A solenoid for driving a printing wire in a matrix printer in accordance with claim 4 wherein the angle of each of said air gaps with respect to said central axis is greater than or equal to twenty degrees and less than or equal to thirty-five degrees.

6. A solenoid for driving a printing wire in a matrix printer in accordance with claim 5 wherein said printing wire is adhesively bonded to said plunger in an axial bore within said plunger.

7. A solenoid for driving a printing wire in a matrix printer in accordance with claim 4 further comprising:

a plunger return spring between said plunger and a spring retaining surface for maintaining said plunger in a fixed position prior to energization of said coil and for returning said plunger to said fixed position when said coil is deenergized.

8. A solenoid for driving a printing wire in a matrix printer in accordance with claim 7 wherein said plunger spring is a conical coil spring.

9. A solenoid for driving a printing wire in a matrix printer in accordance with claim 7 wherein said plunger return spring is a straight coil spring.

10. A solenoid for driving a printing wire in a matrix printer in accordance with claim 7 further comprising:

a bobbin upon which said coil is wound, one surface of said bobbin defining said spring retaining surfaces; and means for urging said bobbin against said annular pole piece.

11. A solenoid for driving a printing wire in a matrix printer in accordance with claim 10 wherein said means for urging comprises a curved spring washer.

12. A solenoid for driving a printing wire in a matrix printer in accordance with claim 7 further comprising:

an end cap rigidly secured to the substantially closed end of said housing for providing at a surface thereof said fixed position for said plunger.

13. A solenoid for driving a printing wire in a matrix printer in accordance with claim 12 wherein said end cap is comprised of a plastic non-magnetic material.

14. In a matrix printer head containing a plurality of solenoids each driving a printing wire for printing a dot matrix of characters in response to selective energization of said solenoids, the improvement in each of said solenoids comprising:

a coil energizable in response to a magnetizing current;

flux conductive means including a metal housing having an inwardly extending stationary core member and an annular pole piece spaced from said core member and including a movable flanged end plunger for providing a substantially continuous path for magnetic flux generated in response to the energization of said coil, said path being interrupted by first and second low reluctance air gaps, said first air gap being between a non-flanged end of said plunger and said core member and said second air gap being between the flanged end of said plunger and said pole piece, such that accelerating force is generated on said plunger by each of said air gaps; and wherein said air gaps are defined by opposing conical surfaces on said plunger non-flanged end and said core member, and said plunger flanged end and said pole piece, said opposing conical surfaces being at an angle within the range of about 20° to 35° with respect to an axial centerline through said plunger along the direction of motion thereof.

15. The improvement in accordance with claim 14 further including:

plunger return spring means for returning said plunger to its starting position upon deenergization of said coil; and end cap means fastened to said housing for providing an end stop for said plunger.

16. The improvement in accordance with claim 15 further comprising:

a printing wire adhesively bonded to said plunger and movable therewith; and an axial bore within said plunger for receiving said printing wire.

17. A high speed dot matrix printing head comprising:

housing means for containing a plurality of wires in a linear configuration;

a plurality of solenoid drivers for propelling said wires, each of said solenoid drivers having a longitudinally reciprocally movable flanged end plunger affixed to a respective printing wire, and each of said solenoid drivers further including:

an energizing coil;

a substantially continuous, non-restrictive flux conductive means for providing a flux path, said flux path passing through the flanged end and a non-flanged opposite end of said movable plunger; and a first low-reluctance air gap and a second low-reluctance air gap between conical surfaces of said plunger flanged and non-flanged ends and companion conical surfaces of an associated annular pole piece and central core member of said flux conductive means for driving said plunger in response to the generation of accelerating force on said plunger by each of said first and second air gaps during energization of said coil.

18. A high speed dot matrix printing head in accordance with claim 17 wherein the angle subtended by each of said plunger conical surfaces with respect to the direction of motion of said plunger is greater than or equal to 20° and less than or equal to 35°.

19. A high speed dot matrix printing head in accordance with claim 17 further comprising:

a non-magnetic end cap rigidly attached to one end of said flux conductive means for providing an end stop for said plunger;

a plunger return spring having one end coupled to the flanged end of said plunger for returning said plunger to said end stop upon deenergization of said coil; and bobbin means upon which said coil is wound having a surface urged against said annular pole piece of said flux conductive means and another surface for providing a seat for the other end of said plunger return spring.

20. A high speed dot matrix printing head in accordance with claim 19 wherein said flux conductive means includes a metallic housing having said central core member extending inwardly from one end thereof and having said annular pole piece spaced from said core member and substantially closing the other end thereof, and wherein the conical surface of said pole piece extends outwardly for mating with the conical surface extending inwardly from the flanged end of said plunger.

21. In a matrix printer head containing a solenoid driven printing wire for printing a dot matrix of characters in response to energization of said solenoid, the improvement in said solenoid comprising:

a coil energizable in response to a magnetizing current;

flux conductive means including a metal housing having an inwardly extending stationary central core member and an annular pole piece spaced from said core member and including a movable plunger having a flanged rear end for providing a substantially continuous path for magnetic flux generated in response to the energization of said coil, said path being interrupted by first and second low reluctance air gaps, said first air gap being between an outer conical surface of a forward non-flanged end of said plunger and an opposing inner conical surface of said core member and said second air gap being between an inner conical surface of the flanged end of said plunger and an opposing outer conical surface of said pole piece, such that accelerating force is generated on said plunger by each of said air gaps; and wherein said opposing surfaces defining said air gaps are at an angle within the range of about twenty to thirty-five degrees with respect to an axial centerline through said plunger along the direction of motion thereof.

22. The improvement in accordance with claim 21 further including:

plunger return spring means for returning said plunger to its starting position upon deenergization of said coil; and end cap means fastened to said housing for providing and end stop for said plunger.

23. The improvement in accordance with claim 21 further comprising:

an axial bore through said plunger; and a printing wire adhesively bonded within said bore and movable with said plunger.

24. A solenoid for driving a printing wire in a matrix printer comprising:

a coil for providing magnetic flux when energized by an electrical current;

means for providing a substantially continuous, non-restricted path for said magnetic flux including a housing, a stationary core member closing one end of said housing, an annular pole piece spaced from said core member and substantially closing the other end of said housing, and a flanged end plunger movable normal to said pole piece and in an axial direction with respect to said core member;

a first low reluctance air gap between said core member and said plunger;

a second low reluctance air gap between said pole piece and said plunger, said first air gap being formed on one side thereof by a conical surface of a non-flanged end of said plunger and on the other side by a conical surface of said core member and wherein said second air gap is formed on one side thereof by another conical surface of the flanged end of said plunger and on the other side by a conical surface of said pole piece such that said air gaps have an angle with respect to said central axis of approximately 30°;

a printing wire fastened to said plunger extending through said core member and movable with said plunger;

means for energizing said coil such that a composite accelerating force is generated on said plunger, said composite accelerating force being generated in part by each of said air gaps; and a plunger return spring between said plunger and a spring retaining surface for maintaining said plunger in a fixed position prior to energization of said coil and for returning said plunger to said fixed position when said coil is deenergized.

* * * * *